United States Patent [19]

Leifeld

[11] Patent Number: 4,811,463

[45] Date of Patent: Mar. 14, 1989

[54] FIBER TUFT FEEDER FOR A TEXTILE PROCESSING MACHINE

[75] Inventor: Ferdinand Leifeld, Kempen, Fed. Rep. of Germany

[73] Assignee: Trützschler GmbH & Co. KG, Mönchen-Gladbach, Fed. Rep. of Germany

[21] Appl. No.: 101,863

[22] Filed: Sep. 5, 1987

[30] Foreign Application Priority Data

Oct. 1, 1986 [DE] Fed. Rep. of Germany ..... 3633398

[51] Int. Cl.[4] ..... D01G 23/02; D01G 15/40; D01G 9/16

[52] U.S. Cl. ..... 19/105; 19/205

[58] Field of Search ..... 19/105, 205

[56] References Cited

U.S. PATENT DOCUMENTS

| | | | |
|---|---|---|---|
| 3,728,759 | 4/1973 | Hergeth | 19/105 |
| 3,930,285 | 1/1976 | Wornall | 19/105 X |
| 4,009,803 | 3/1977 | Lytton et al. | 19/105 X |
| 4,656,694 | 4/1987 | Windges | 19/105 |
| 4,661,025 | 4/1987 | Pinto et al. | 19/105 X |
| 4,682,388 | 7/1987 | Pinto | 19/105 |

FOREIGN PATENT DOCUMENTS 2628120 2/1977 Fed. Rep. of Germany .

*Primary Examiner*—Louis K. Rimrodt
*Attorney, Agent, or Firm*—Spencer & Frank

[57] ABSTRACT

An apparatus for feeding fiber material to a fiber processing machine includes a vertically-oriented fill chute having an open top, a bottom and a generally rectangular cross section of opposite narrow sides and opposite wide sides; a duct having an open end communicating with the fill chute adjacent the top thereof at one of the wide sides for introducing a fiber material-carrying airsteam into the fill chute; air outlet openings provided in the fill chute for allowing passage of air from the fill chute; and a discharging arrangement for withdrawing fiber material from the bottom of the fill chute. The duct has a terminal length portion ending in the outlet opening and the terminal length portion has an at least approximately quadrate cross section. There is further provided a space of impact between the outlet opening and the open top of the fill chute; the outlet opening is at least approximately centered with respect to a horizontal middle of the space of impact.

8 Claims, 2 Drawing Sheets

FIBER TUFT FEEDER FOR A TEXTILE PROCESSING MACHINE

BACKGROUND OF THE INVENTION

This invention relates to an apparatus for feeding fiber tufts to a carding machine, a roller card unit, an opener, a cleaner or a similar type of fiber processing machine. The apparatus has a fill chute of generally rectangular cross section into which the fiber material is introduced at the top through a pneumatic duct joined to the fill chute at the wide side thereof. The fiber material is withdrawn from the fill chute at the bottom thereof. An airstream passes through the fill chute and is withdrawn through air outlet openings provided in the fill chute.

In practice fill chutes are used for making a fiber lap which is introduced as the input material for openers, cleaners, carding machines or tuft feeders. An air/tuft mixture is blown into the fill chute which contains air outlet openings constituted by perforated plates, slots, air-pervious fabrics, comblike structures or the like through which the air may exit from the fill chute. The fiber tufts are deposited in the chute to form a tuft column therein. The fill chutes have a certain depth which determines the thickness of the fiber lap withdrawn from the fill chute and a width which corresponds to the working width of the after-connected (downstream) processing machine.

German Offenlegungsschrift (non-examined published application No. 2,628,120) discloses a single-chute apparatus which, for improving the transverse distribution of the fiber tufts over the width of the feeder, has mechanisms to generate an alternating transverse airstream. It is a disadvantage of such an arrangement that it is complex and does not result in satisfactory distribution of the fiber tufts.

In tuft feeders which have an upper or reserve chute upstream of the feed chute, such as used in the EXACTAFEED FBK model, manufactured by Trützschler GmbH & Co. KG, Mönchengladbach, Federal Republic of Germany, transversely to the direction of discharge of the produced fiber lap, the tuft/air mixture is blown into a chute having apertures provided by a comblike structure. Since the fiber column situated in the feed chute and separated from the airstream is constantly withdrawn from below, the comlike construction is zonewise exposed. The tuft-carrying air may have easy access to those locations, resulting in an obturation of the apertures. Fiber tuft mounds accumulating above the comblike structure are blown away by the transverse air flow. It is possible that during operation the fiber tuft density is on the feed side different from that on the opposite side. Such differences remain constant and can practically not be compensated for.

For a high-requirement, single-chute feeding with high accuracy, the earlier-noted transverse charging cannot be used. In prior art constructions funnellike structures are used which gradually change from the circular cross section of the inlet duct into a rectangular shape, corresponding to the dimensions of the feed chute. Such funnels may be of bent construction to change a horizontal tuft flow into a vertical direction in which the deposition of the tufts in the feed chute takes place. The funnel constructions can have only small angles to achieve any useful fiber tuft distribution. Such a structural arrangement, however, often requires a prohibitively large inlet flow space. Such solutions are furthermore unsatisfactory in any event because it has been repeatedly found that changes in the flow direction occur which are often unpredictable and are not reversible: Once the material flow has chosen one side of the chute as the preferred side, it cannot be deflected therefrom. Also, the twist provided in the supply duct irreversibly determines the flight direction of the fiber tufts upon entrance into the distributor funnel. Further, it has been attempted to influence the flow within the duct with flow guiding devices such as deflectors, and also to reduce the effect of the duct bends on the flight of the fiber tufts within the conduits. The results, however, have been far from satisfactory.

SUMMARY OF THE INVENTION

It is an object of the invention to provide a fill chute charging device which causes a fiber tuft column to be deposited in the fill chute and wherein the density of the column remains constant as viewed along the chute width and over time, and is independent from the flight path in the supply ducts and tubular conduits.

This object and others to become apparent as the specification progresses, are accomplished by the invention, according to which, briefly stated, between the end of the supply duct and the location of entrance into the fill chute a space of impact is provided such that the terminus of the duct is situated approximately in the middle of the space of impact and the cross section of the supply duct is at least approximately quadrate.

Thus, according to the invention, the fiber tufts are not distributed over the width of the fill chute, but are guided in a concentrated manner into the middle thereof. The distribution of the fiber tufts over the shaft width occurs by virtue of a preferably obliquely positioned baffle element such as a baffle plate which simultaneously serves for changing the direction of the horizontally incoming fiber tuft stream into a vertical, downwardly oriented course. Between the location of impact and the air outlet openings provided in the fill chute there is provided a required determined flight length which is selected such that the enveloping curves of the rebounding tuft stream reaches reliably the lateral boundaries of the fill chute prior to reaching the air outlet openings. The airstream is adjusted such that there is obtained an impact speed of at least 5 m/sec. The supply duct is formed of a tube of quadrate cross section which opens immediately into the space of impact. The quadrate tube is of linear configuration, it opens perpendicularly into the space of impact and is at least 2.5 meter long. It has been found that in the linear quadrate supply tube the twisted course of the fiber tuft motions caused by an upstream-located supply conduit of circular cross section is completely eliminated.

It has been unexpectedly found that already in the quadrate tube a certain, continuously alternating orientation of the flight paths of the fiber tufts takes place, corresponding to the air outlet openings.

Contrary to a supply channel of rectangular cross section whose opposite large faces are of horizontal orientation and in which there occurs a flow orientation which, however, does not change, but generates sudden stationary flow fields, in case of a supply conduit of quadrate cross section, a continuously changing flow direction and thus a scatter effect over the entire width is achieved. This arrangement also results in a superior distribution of the fiber tufts as viewed over time. Even those ducts of rectangular cross sections in which the large faces are vertically oriented and which significantly differ from quadrate shapes, do not have an advantageous effect because the tuft flow is neither concentrated, nor rapid, nor does it impinge and thus a continuously alternating adaptation in a horizontal direction to correspond to the air outlet openings cannot take place.

According to further advantageous features of the invention

- the space of impact has a baffle wall which is situated opposite the end of the supply duct at a distance therefrom;
- the baffle wall has an oblique surface which directs the tuft flow from the supply duct into the fill chute;
- the width of the space of impact corresponds to the width of the fill chute;
- the supply duct opens into the space of impact; the supply duct opens perpendicularly into the space of impact; and
- the space of impact of the fiber tufts is at least by one chute width above the air outlet openings in the fill chute.

The air outlet openings may be formed by a comblike structure, an apertured sheet metal member, a sieve, a slotted wall and the like.

DESCRIPTION OF THE PREFERRED EMBODIMENT

Figure 1:
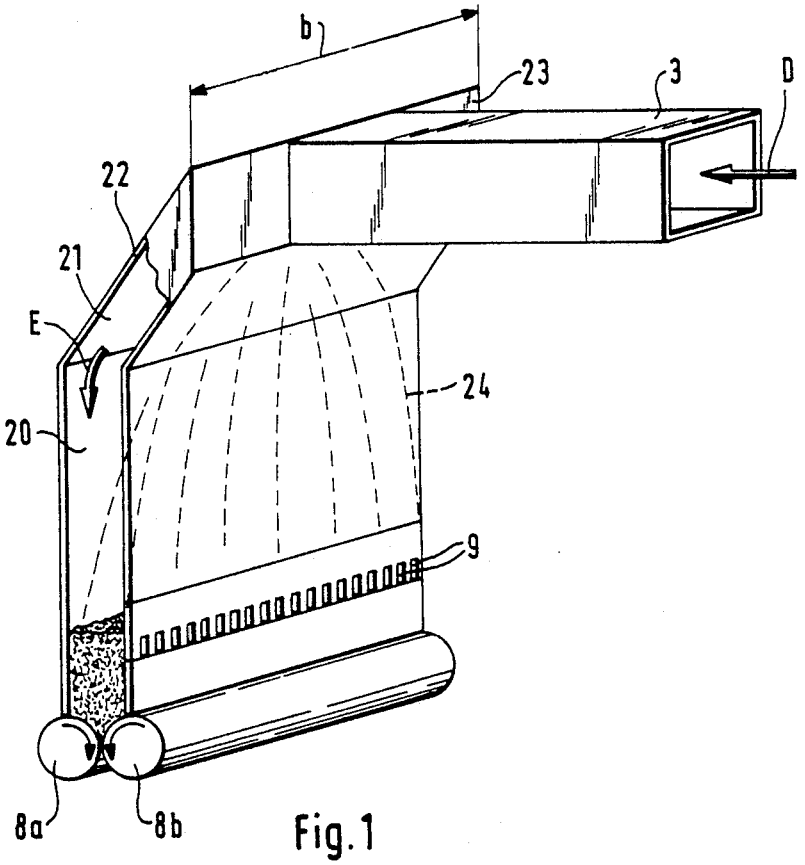
FIG. 1 is a schematic perspective view of a preferred embodiment of the invention.

Turning to FIG. 1, there is illustrated a fill chute 20 of rectangular cross section, into which fiber material is introduced by means of a pneumatic duct 3 in which the fiber material flows in the direction of an arrow D. The supply duct 3 opens into one of the wide sides of the fill chute 20. The fiber material is introduced from above into the fill chute 20 and is withdrawn therefrom at the bottom by means of cooperating pull-off rollers 8*a*, 8*b*. A fiber tuft-laden airstream enters the fill chute 20 and is thereafter separated from the fiber tufts and exits through air outlet openings 9 formed, for example, by a comblike structure. A space of impact 21 is provided between the end of the supply duct 3 and the entrance opening to the fill chute 20. The open end of the duct 3 is provided at the top of the space of impact 21, in the horizontal middle thereof.

The cross-sectional configuration of the supply duct 3 is quadrate and has a length of 2.5 meter. In the zone of entrance into the space of impact 21, the supply duct is of linear configuration. The space of impact 21 has a baffle wall 22 which faces the opening of the supply duct 3 and is arranged at a distance a therefrom. The baffle wall 22 is an oblique surface which directs the tuft/air flow downwardly into the fill chute 20 from the supply duct 3. The width b of the space of impact 21 corresponds to the width of the fill chute 20. The supply duct 3 opens perpendicularly into the frontal wall 23 of the space of impact 21.

The impinging speed of the tuft/air mixture flowing from the supply duct 3 onto the baffle wall 22 is approximately 5 m/sec. The distance of the location of impact for the fiber tufts at the baffle wall 22 from the air outlet openings 9 at the lower part of the fill chute 20 is greater than the width b thereof. The envelope curve 24 which is the outer boundary of the downwardly falling fiber tuft flow is illustrated in broken lines. The fiber tufts are delivered into the fill chute 20 by their own weight and by the airstream E.

Figure 2:
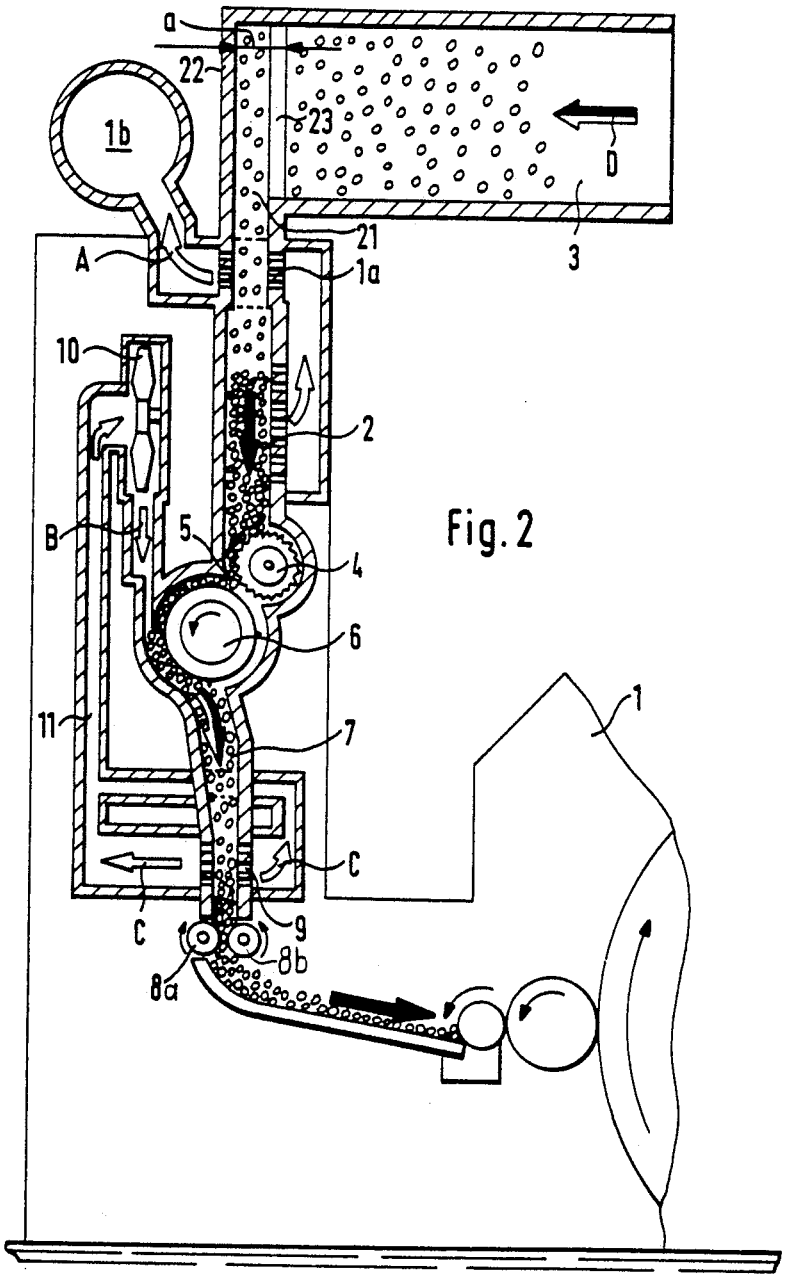
FIG. 2 is a schematic side elevational view of a card feeder incorporating the invention.

Turning now to FIG. 2, upstream of a carding machine 1 there is provided a vertical reserve chute 2 which is charged at the top with finely opened fiber material. The charging is effected pneumatically through a supply duct 3 which also serves as a distributor duct for a plurality of tuft feeders. In the upper region of the reserve chute 2 there are provided air outlet openings 1*a* through which he conveying air is, after separation from the fiber tufts, withdrawn by a suction device 1*b* as indicated by the arrow A. The lower end of the reserve chute 2 is closed off by a feed roller 4 which, in cooperation with a feed tray 5 advances the fiber material from the reserve chute 2 to an underlying opening roller 6. The latter is provided with opening pins or a sawtooth wire and bounds with a part of its circumference a feed chute 7. The opening roller 6 rotating in the direction as indicated by the arrow drawn therein, delivers the fiber material into the feed chute 7 which has at its bottom end two cooperating pull-off rollers 8*a*, 8*b* which withdraw the material from the feed chute 7 and advance it towards the carding machine 1. Such a card feeder may be, for example, an "EXACTAFEED FBK" model, manufactured by Trützschler GmbH & Co. KG, Mönchengladbach, Federal Republic of Germany. The walls of the feed chute 7 are, in the lower part, up to a certain height, provided with air outlet openings 9. At the top the feed chute 7 is in communication with a boxlike space to the upper end of which the pressure side of a fan 10 is connected. By means of the rotating feed roller 4 and the opening roller 6 fiber material is delivered continuously and at a certain flow rate to the feed chute 7 and an equal quantity of fiber material is withdrawn through the pull-off rollers 8*a*, 8*b* from the feed chute 7 and advanced toward the card 1. In order to achieve a uniform and constant densification of the fiber column in the feed chute 7, the fan 10 supplies a compressing airstream downwardly into the feed chute 7. The fan 10 draws air from a return channel 11 and pushes the air through the fiber mass dwelling in the feed chute 7. Thereafter the air exits through the air outlet openings 9 at the lower end of the feed chute 7, as illustrated by the arrows C. The air return channel 11 communicates with the air outlet openings 9 at one end thereof while its other end is connected to the intake (suction) side of the fan 10.

The supply duct 3 opens into the space of impact 21 at the frontal wall 23 of the space of impact 21. The tuft/air mixture arriving from the supply duct 3 traverses the space of impact 21, impinges on the baffle wall 22, is braked and deflected downwardly into the reserve chute 2.

It will be understood that the above description of the present invention is susceptible to various modifications, changes and adaptations, and the same are intended to be comprehended within the meaning and range of equivalents of the appended claims.

What is claimed is:

1. In an apparatus for feeding fiber material to a fiber processing machine; the apparatus including a vertically-oriented fill chute having an open top, a bottom and a generally rectangular cross section of opposite narrow sides and opposite wide sides: fiber charging means including a duct having an open end communicating with the fill chute adjacent the top thereof at one of said wide sides for introducing a fiber material-carrying airstream into the fill chute; air outlet openings provided in the fill chute for allowing passage of air from the fill chute; and discharge means for withdrawing fiber material from said bottom of the fill chute; the improvement wherein said duct has a terminal length portion ending in said outlet opening; said terminal length portion having an at least approximately quadrate cross section; the improvement further comprising means defining a space of impact between said opening and said open top of said fill chute; said opening being at least approximately centered with respect to a horizontal middle of said space of impact.

2. An apparatus according to claim 1, wherein said terminal length portion of said duct is linear and has a length of approximately 2.5 meter.

3. An apparatus according to claim 1, wherein said means defining a space of impact includes a baffle wall facing said outlet opening of said duct and being arranged at a distance therefrom.

4. An apparatus according to claim 3, wherein said terminal length portion is horizontal; further wherein said baffle wall is arranged at an oblique angle to the horizontal and is oriented obliquely towards said fill chute for directing said fiber material-carrying airstream into said fill chute.

5. An apparatus according to claim 3, wherein said fill chute has a width measured parallel to said wide sides thereof and further wherein said baffle wall has a zone of impact where fiber material flying from said open end of said duct into said space of impact impinges on said baffle wall; said zone of impact of said baffle wall being situated above said air outlet openings at a distance corresponding to at least said width.

6. An apparatus according to claim 1, wherein said fill chute and said space of impact have equal widths measured parallel to said wide sides of said fill chute.

7. An apparatus according to claim 1, wherein said open end of said duct merges directly into said space of impact.

8. An apparatus according to claim 1, wherein said terminal length portion of said duct is perpendicular to said wide sides of said fill chute.

* * * * *